US005509384A

United States Patent [19]

Schmid

[11] Patent Number: 5,509,384

[45] Date of Patent: Apr. 23, 1996

[54] VARIABLE VALVE TIMING GEAR

[75] Inventor: Peter Schmid, Pleidelsheim, Germany

[73] Assignee: Dr. Ing. h.c.F. Porsche AG, Weissach, Germany

[21] Appl. No.: 309,132

[22] Filed: Sep. 20, 1994

[30] Foreign Application Priority Data

Sep. 21, 1993 [DE] Germany ..... 43 31 977.7

[51] Int. Cl.[6] ..... F01L 1/34

[52] U.S. Cl. ..... 123/90.17; 123/90.6; 74/568 R

[58] Field of Search ..... 123/90.15, 90.17, 123/90.18, 90.31, 90.6; 74/567, 568 R

[56] References Cited

U.S. PATENT DOCUMENTS

| | | | |
|---|---|---|---|
| 2,888,837 | 6/1959 | Hellmann | 123/90.17 |
| 4,498,352 | 2/1985 | Hedelin | 123/90.17 |
| 4,771,742 | 9/1988 | Nelson et al. | 123/90.17 |
| 4,917,058 | 4/1990 | Nelson et al. | 123/90.17 |
| 5,105,679 | 4/1992 | Voigt | 123/90.17 |
| 5,136,887 | 8/1992 | Elrod et al. | 123/90.17 |
| 5,211,141 | 5/1993 | Hannibal et al. | 123/90.17 |
| 5,253,622 | 10/1993 | Bornstein et al. | 123/90.17 |
| 5,307,768 | 5/1994 | Beier et al. | 123/90.17 |

FOREIGN PATENT DOCUMENTS

| | | | |
|---|---|---|---|
| 2644543 | 9/1990 | France . | |
| 2921645 | 12/1980 | Germany . | |
| 3934848 | 4/1991 | Germany | 123/90.17 |
| 59-183009 | 10/1984 | Japan . | |
| 224407 | 9/1989 | Japan | 123/90.17 |
| 1271606 | 10/1989 | Japan . | |

OTHER PUBLICATIONS

"Design and Development of a Variable Valve Timing (VVT) Camshaft," Carl A. Schiele et al., Society of Automotive Engineers, Inc., Automotive Engineering Congress, Paper 740 102, Feb. 25–Mar. 1, 1994, p. 2.

*Primary Examiner*—Weilun Lo

*Attorney, Agent, or Firm*—Evenson, McKeown, Edwards & Lenahan

[57] ABSTRACT

A variable valve timing gear is suitable for internal-combustion engines of a piston construction which comprise intake and exhaust valves for the charge cycle control. The intake and exhaust valves are actuated by a camshaft which has intake and exhaust cams for this purpose. For influencing the valve overlap of the intake and exhaust valves, the intake and exhaust valves are constructed so that they can be rotated with respect to one another, for which a control arrangement is provided. This control arrangement is provided with a control element which is axially movably arranged in a bore of the camshaft and rotates the intake cams with respect to the exhaust cams via drivers constructed as pins and control guides.

11 Claims, 2 Drawing Sheets

VARIABLE VALVE TIMING GEAR

BACKGROUND AND SUMMARY OF THE INVENTION

This invention relates to a variable valve timing gear for internal combustion engines of the type having intake and exhaust valves actuated by means of cams of a camshaft, some of which cams being rotatable relatively to other of the cams for controlling the valve overlap of the intake and exhaust valves with respect to one another.

As a result of variable valve timing gears, not only crude HC-emissions can be favorably influenced but $NO_x$-emissions can also be reduced. These variable valve timing gears can also improve the fuel consumption, the idling stability, the torque and the output of an internal-combustion engine. For this purpose, valve overlaps of the intake and exhaust valves are changed in such a manner that, at low rotational speeds, there will be a relatively small overlap and, at higher rotational speeds, there will be a relatively large overlap.

According to US-SAE Paper 740 102, Page 2, FIG. 1, a variable valve timing gear is known in which an axially movable control element is provided in a bore of a camshaft and engages by means of a driver in a curved control guide causing a rotation of the intake cams. Although this construction supplies a vague constructional direction, it is still removed from a solution that can be implemented in practice.

Based on this prior art, it is therefore an object of the invention to provide an improved variable valve timing gear with intake cams and exhaust cams which can be rotated with respect to one another. This valve timing gear can be implemented without any problems and operates well.

This object is achieved according to preferred embodiments of the invention by providing a variable valve timing gear for an engine of piston-type construction comprising intake and exhaust valves for charge cycle control which are actuated by means of camshaft cams, some of which cams are rotatable for influencing the valve overlap of the intake and exhaust valves with respect to one another, said variable valve timing gear including a control arrangement which includes a control element which is axially movable in an axial bore of the camshaft, which control element causes rotational adjustment of the intake cams with respect to the exhaust cams via drivers and control guides, wherein the drivers are pins of the control element penetrating guide openings in the camshaft and engaging in grooves constructed as control guides in bearing bores of the intake cams which are rotatably disposed on the camshaft.

Principal advantages achieved by means of the invention are that the control element with its drivers, which engage in grooves of the intake cams, can not only be implemented easily from a constructional point of view but is also operationally reliable and highly effective with respect to the rotating function of the intake cams. In this case, the control element as well as the camshaft have a simple construction. The camshaft may be a so-called built or assembled camshaft on which the exhaust cam, bearing bushes or the like are fixed and the inlet cams are disposed in a rotatable manner. The control arrangement comprises a hydraulic system and a solenoid, is arranged on an end face of the camshaft which is favorable with respect to space and may optionally also be construction as a suppliable module which can be used, for example, as a variant with respect to a camshaft with fixed intake and exhaust valves in the case of engines which have the same construction but a different output profile. Finally, this type of camshaft adjustment is suitable for so-called single-camshaft internal-combustion engines in which the intake and the exhaust valves are arranged on a common shaft.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
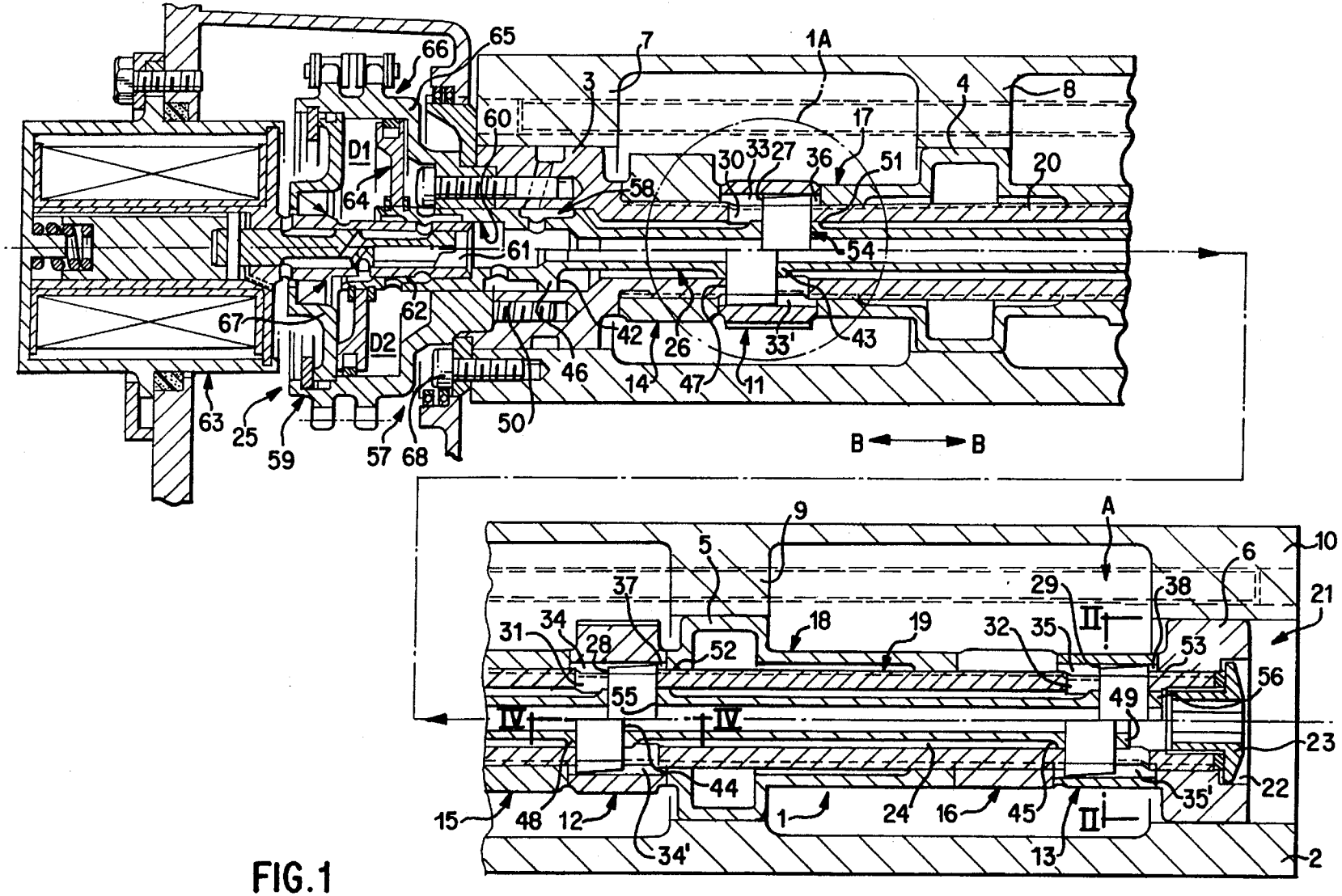
FIG. 1 is a sectional view of an internal-combustion engine camshaft in the area of a camshaft housing with the variable valve timing gear according to the invention.
Figure 1A:
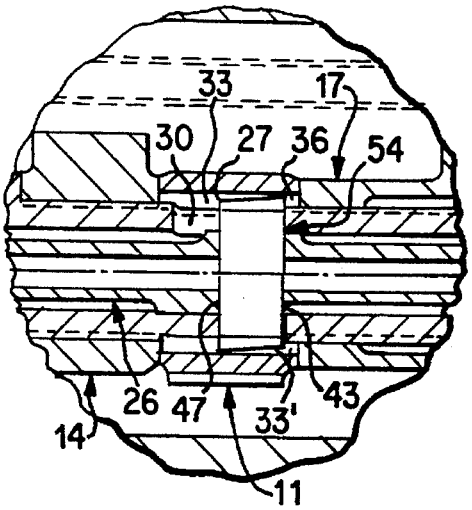
FIG. 1A is a sectional view of detail A in FIG. 1, showing a second position of the system.

Referring to FIG. 1, a camshaft 1 with a variable timing gear is arranged in a camshaft housing 2 which bounds combustion chambers of cylinders or of a cylinder head of a multicylinder spark-ignited internal-combustion engine of piston-type construction with intake and exhaust lifting valves. Since those skilled in the art are familiar with this type of engine, further details are not illustrated and described herein.

For the bearing of the camshaft 1, journals 3, 4, 5, 6 are used which interact with corresponding bearing blocks 7, 8, 9, 10 of the camshaft housing 2.

The journal 3 is made of one piece with the camshaft 1. Journals 4, 5 and 6 are constructed to be separate. This is therefore a camshaft which is composed of several components and for which the term "built" or "assembled" camshaft is also used. In addition, the following components are arranged on the camshaft 1: Intake cams 11, 12, 13 and exhaust cams 14, 15, 16. Journals 4 and 5 are components of the bearing bushes 17, 18 surrounding the camshaft 1. On its outer circumferential surface 19, the camshaft 1 is provided with a toothing 20 extending in the axial direction B—B on which the exhaust cams 14, 15, 16, the bearing bushes 17, 18 and the bearing 6 bounding one face 21 of the camshaft 1 are non-rotatably fixed while being constructed correspondingly. At reference number 22, a closing element 23 is inserted into a through-bore 24 of the camshaft 1.

Figure 2:
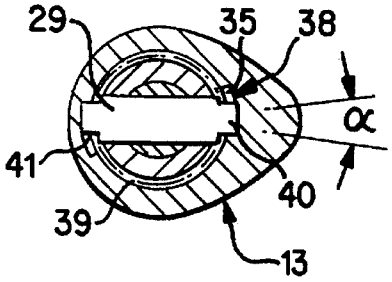
FIG. 2 is a partial sectional view taken along Line II—II of FIG. 1.
Figure 3:
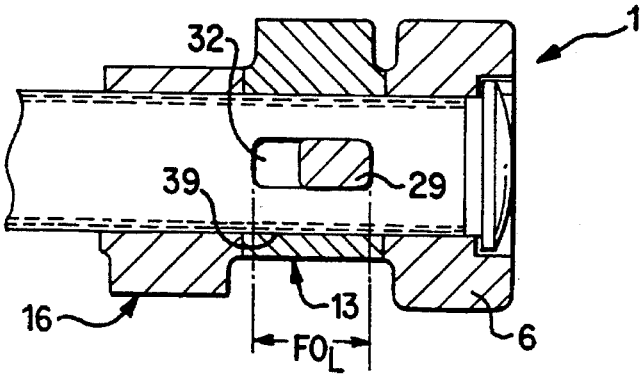
FIG. 3 is a view in the direction of the arrow A of FIG. 1.
Figure 4:
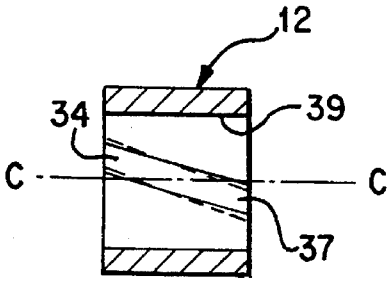
FIG. 4 is a sectional view taken along Line IV—IV of FIG. 1.

Inside the bore 24, a control element 26 is arranged which is part of a control arrangement 25, is constructed to be axially movable—B—B direction—and has a tube-shaped configuration. The control element 26 has pins 27, 28, 29 which are constructed as drivers and which penetrate slot-shaped guide openings (FIG. 3) 30, 31, 32 in the camshaft 1 and interact with grooves 33, 34, 35 of control guides 36, 37, 38 of the intake cams 11, 12, 13. The control guides 36, 37, 38 are set diagonally with respect to a longitudinal center plane C—C of the camshaft 1 (FIG. 4), whereby longitudinal movements—direction B—B —of the control element 26 in the area of the length $FO_L$ of the guide openings 30, 31, 32 result in rotational movements—angle $\alpha$ (FIG. 2)—of the intake cams 11, 12, 13.

The grooves 33, 34, 35 and the opposite grooves 33', 34', 35' are entered from a bearing bore 39 of the respective intake cam, such as 13, in which case the pin sections 40, 41 of the pins 27, 28, 29 engage in the grooves 33, 34, 35 and the grooves 33', 34', 35' which are opposite to them.

Distributed along its length, the control element 26 comprises several piston-type guide sections 42, 43, 44 and 45 which are represented as local bearing enlargements 46, 47, 48, 49 and interact with cylinder sections 50, 51, 52, 53 of the bore 24 of the camshaft 1.

In the embodiment shown, the pins 27, 28, 29, which may be pressed into openings 54, 55, 56 of the control element 26, are provided in the area of the bearing enlargements 47, 48, 49. The bearing enlargement 46, which extends adjacent to the other face 57 of the camshaft, is constructed as an oil feeding device 58 for a hydraulic system 59. In this case, the bearing enlargement 46 has a sliding bore 60 for a stationary cylinder into which an axial slide 62 is inserted. The axial slide 62 is connected with a solenoid 63. In addition, a hydraulic piston 64 is fastened to the bearing enlargement 46, is surrounded by a housing 65 and can be acted upon by hydraulic oil via a first pressure space D1 and a second pressure space D2. The housing 6S is circular and has transmitting devices 66 on its outside—gear rim, belt rim —for belts, chains of the like by means of which the camshaft 1 is driven by a crankshaft. Reference number 67 indicates a closing part for the housing 65 which bounds the pressure space D1. Screws 68, which are aligned in the axial direction B—B of the camshaft, are used for fastening the hydraulic system 59 to the camshaft 1.

The camshaft 1 comprising the hydraulic system 59 and the control device 25, or possibly only housing 65, may be a prefabricated module which can be inserted into the camshaft housing 2, and may possibly be exchangeable for a camshaft with stationary intake cams.

The control points for the control arrangement 25, which cause an adjustment of the intake cams 11, 12, 13, may be determined by means of a computer as a function of the parameters of engine rotational speed, load, accelerator pedal position, and oil temperature.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Variable valve timing gear for internal-combustion engines of a piston-type construction comprising intake and exhaust valves for charge cycle control which are actuated by means of camshaft cams, some of which cams are rotatable for influencing the valve overlap of the intake and exhaust valves with respect to one another, said variable valve timing gear including a control arrangement which includes a control element which is axially movable in an axial bore of the camshaft, the control element causing rotational adjustment of the intake cams with respect to the exhaust cams via drivers and control guides, wherein the drivers are pins of the control element, said pins penetrating guide openings in the camshaft and engaging in grooves constructed as control guides in bearing bores of the intake cams which are rotatably disposed on the camshaft, and wherein the control element has a tube-type construction and has several piston-type guide sections distributed along its length, the guide sections interacting with cylinder sections of the bore of the camshaft.

2. Variable valve timing gear according to claim 1, wherein the control element at one end face of the camshaft is arranged with a bearing enlargement allowing an oil feed for a hydraulic system of the control arrangement.

3. Variable valve timing gear according to claim 1, wherein the camshaft and at least some parts of the control arrangement are constructed as a prefabricated module.

4. Variable valve timing gear according to claim 1, wherein the guide sections are formed by local enlargements.

5. Variable valve timing gear according to claim 1, wherein the guide sections are provided in the area of the pins.

6. Variable valve timing gear according to claim 4, wherein the guide sections are provided in the area of the pins.

7. Variable valve timing gear for internal-combustion engines of a piston-type construction comprising intake and exhaust valves for charge cycle control which are actuated by means of camshaft cams, some of which cams are rotatable for influencing the valve overlap of the intake and exhaust valves with respect to one another, said variable valve timing gear including a control arrangement which includes a control element which is axially movable in an axial bore of the camshaft, the control element causing rotational adjustment of the intake cams with respect to the exhaust cams via drivers and control guides, wherein the drivers are pins of the control element, said pins penetrating guide openings in the camshaft and engaging in grooves constructed as control guides in bearing bores of the intake cams which are rotatably disposed on the camshaft, and wherein the control element at one end face of the camshaft is arranged with a bearing enlargement allowing an oil feed for a hydraulic system of the control arrangement.

8. Variable valve timing gear according to claim 7, wherein the bearing enlargement has a bore into which a slide is axially inserted.

9. Variable valve timing gear according to claim 7, wherein the bearing enlargement is connected with a hydraulic piston of the hydraulic system.

10. Variable valve timing gear according to claim 9, wherein the hydraulic piston is housed in a housing which has transmitting devices on its exterior side for endless devices.

11. Variable valve timing gear for internal-combustion engines comprising a control arrangement which includes a control element which is axially movable, the control element causing adjustment of at least one cam with respect to another cam via a respective driver, wherein the respective driver is a pin of the control element, said pin penetrating a guide opening in a camshaft and engaging in at least one groove constructed as a control guide in a bearing bore of the at least one cam which is rotatably disposed on the camshaft, and wherein the control element has a tube-type construction and has at least one piston-type guide section distributed along its length, the at least one guide section interacting with a respective cylinder section of an axial bore of the camshaft.

* * * * *